US007918367B2

(12) United States Patent
O'Donnell

(10) Patent No.: US 7,918,367 B2
(45) Date of Patent: Apr. 5, 2011

(54) APPARATUS AND METHOD FOR MONITORING BULK TANK CRYOGENIC SYSTEMS

(76) Inventor: Kevin P. O'Donnell, Phoenix, AZ (US)

( * ) Notice: Subject to any disclaimer, the term of this patent is extended or adjusted under 35 U.S.C. 154(b) by 0 days.

(21) Appl. No.: 12/786,442

(22) Filed: May 25, 2010

(65) Prior Publication Data

US 2010/0230436 A1 Sep. 16, 2010

(51) Int. Cl.
*B67D 1/00* (2006.01)

(52) U.S. Cl. ..... 222/63; 222/66; 137/113

(58) Field of Classification Search ..... 222/63, 222/1, 394–399, 400.5, 400.7, 55, 59, 61, 222/66; 137/113, 557
See application file for complete search history.

(56) References Cited

U.S. PATENT DOCUMENTS 3,537,616 A * 11/1970 Diebel et al. ..... 222/66
3,756,464 A * 9/1973 Fuqua ..... 222/57
3,981,414 A * 9/1976 Gust et al. ..... 222/38
4,413,752 A * 11/1983 McMillin et al. ..... 222/56
4,544,328 A * 10/1985 Credle, Jr. ..... 417/33
4,732,543 A * 3/1988 Hrycyshyn ..... 417/44.1
4,795,061 A * 1/1989 Peckjian ..... 222/66
4,898,303 A * 2/1990 Large et al. ..... 222/65
4,957,220 A * 9/1990 Du ..... 222/66
5,082,143 A * 1/1992 Schramm, Jr. ..... 222/66
5,293,893 A * 3/1994 O'Dougherty ..... 137/113
5,299,715 A * 4/1994 Feldman ..... 222/129.1
5,730,323 A * 3/1998 Osborne ..... 222/55
5,868,162 A * 2/1999 Dickerson, Jr. ..... 137/557
5,871,121 A * 2/1999 Hashimoto et al. ..... 222/54
6,251,105 B1 * 6/2001 Mikus et al. ..... 606/22

* cited by examiner

*Primary Examiner* — Lien T Ngo
(74) *Attorney, Agent, or Firm* — Wright Law Group, PLLC; Mark F. Wright

(57) ABSTRACT

A system for monitoring and controlling the delivery of $CO_2$ from a bulk storage tank to at least one gas-driven pump is disclosed. By monitoring certain conditions, the flow of $CO_2$ can be quickly and easily terminated if necessary, thereby reducing or eliminating undesirable consequences of $CO_2$ gas flow in abnormal operational scenarios. The invention is particularly well suited for deployment in conjunction with beverage dispensing machines and can be configured to shut down the flow of $CO_2$ if a drop in pressure occurs due to a leak in the system or if a syrup delivery system runs out of product.

20 Claims, 4 Drawing Sheets

APPARATUS AND METHOD FOR MONITORING BULK TANK CRYOGENIC SYSTEMS

CROSS REFERENCE TO RELATED APPLICATION

This non-provisional patent application claims the benefit of U.S. patent application Ser. No. 12/070,958, under 35 U.S.C. §120, which application was filed on 22 Feb. 2008, which application is now pending and which application is incorporated by reference herein.

BACKGROUND OF THE INVENTION

1. Technical Field

The present invention generally relates to systems for storing gas and relates more specifically to monitoring systems for bulk cryogenic storage systems.

2. Background Art

The use of bulk cryogenic storage systems for carbon dioxide (CO2) gas is a relatively recent historical development in the beverage industry. Vacuum jacketed storage containers delivering 300 pounds to 750 pounds or more of liquified $CO_2$ gas are widely used. These containers are configured to deliver gaseous $CO_2$ at pressures above 90 pounds per square inch by converting the liquid $CO_2$ to gas using a natural conversion process through a simple temperature increase effected by ambient temperatures at the location of use.

The gas delivered from such tanks is widely used in conjunction with beverage dispensing machines of the type commonly found in restaurants, convenience stores, theaters, amusement parks and the like. In these environments, the carbon dioxide ($CO_2$) is typically mixed with water to produce carbonated water under pressure. The carbonated water is then mixed with a syrup at the dispensing machine to produce the finished carbonated beverage.

$CO_2$ in its gaseous state is a tasteless, colorless, odorless gas which naturally displaces oxygen. If this gas is accumulated in sufficient density in a closed space, such as a storage room, it may be hazardous, if not lethal. In facilities that initially produce $CO_2$ gas for ultimate delivery and consumption, multiple safety procedures are generally employed. Among these are detectors that are configured to sense when the $CO_2$ gas level in a particular area exceeds a safe level and produce a warning alarm.

Bulk storage tanks, however, frequently are located in a confined area adjacent a beverage dispensing machine, frequently, in a small room one wall or in some other area which is frequented by employees of the establishment using the beverage dispensing machine. $CO_2$ sensors or safety devices are not typically employed where bulk storage tanks are used to supply $CO_2$ to a beverage dispensing machine. In such situations, both employees of the establishment and customers may be exposed to unsafe levels of $CO_2$ gas without their knowledge.

If the syrup box or container used to deliver the flavored syrup to the beverage dispensing machine is empty while the $CO_2$ dispensing line is connected to it, the resultant drop in pressure may allow $CO_2$ gas to pass outwardly into the surrounding area. Also, if a leak should occur in the gas line for delivering the gaseous $CO_2$ to the carbonator or beverage box of a beverage dispensing machine or, if for any reason, there is a failure to turn off the delivery of $CO_2$ gas, a drop in pressure, sometimes sudden, takes place at the bulk storage tank.

A sudden drop in pressure of $CO_2$ delivered from the tank will generally cause the liquid $CO_2$ in the bulk container to turn into "dry ice." When this occurs, further delivery of gaseous $CO_2$ from the tank is precluded. This typically necessitates some type of a service call, since when this occurs, the beverage dispensing machine will cease to operate correctly. Service calls of this type are unscheduled and are may be quite expensive, driving up the operating costs of the entire system. Accordingly, without improvements to the current state of the art for bulk cryogenic storage systems, the operation of these systems will continue to be suboptimal.

BRIEF SUMMARY OF THE INVENTION

A system for monitoring and controlling the delivery of $CO_2$ from a bulk storage tank to at least one gas-driven pump is disclosed. By monitoring certain conditions, the flow of $CO_2$ can be quickly and easily terminated if necessary, thereby reducing or eliminating undesirable consequences of $CO_2$ gas flow in abnormal operational scenarios. The invention is particularly well suited for deployment in conjunction with beverage dispensing machines and can be configured to shut down the flow of $CO_2$ if a drop in pressure occurs due to a leak in the system or if a syrup delivery system runs out of product.

BRIEF DESCRIPTION OF THE FIGURES

The preferred embodiments of the present invention will hereinafter be described in conjunction with the appended drawings, wherein like designations denote like elements, and.

DETAILED DESCRIPTION

Figure 1:
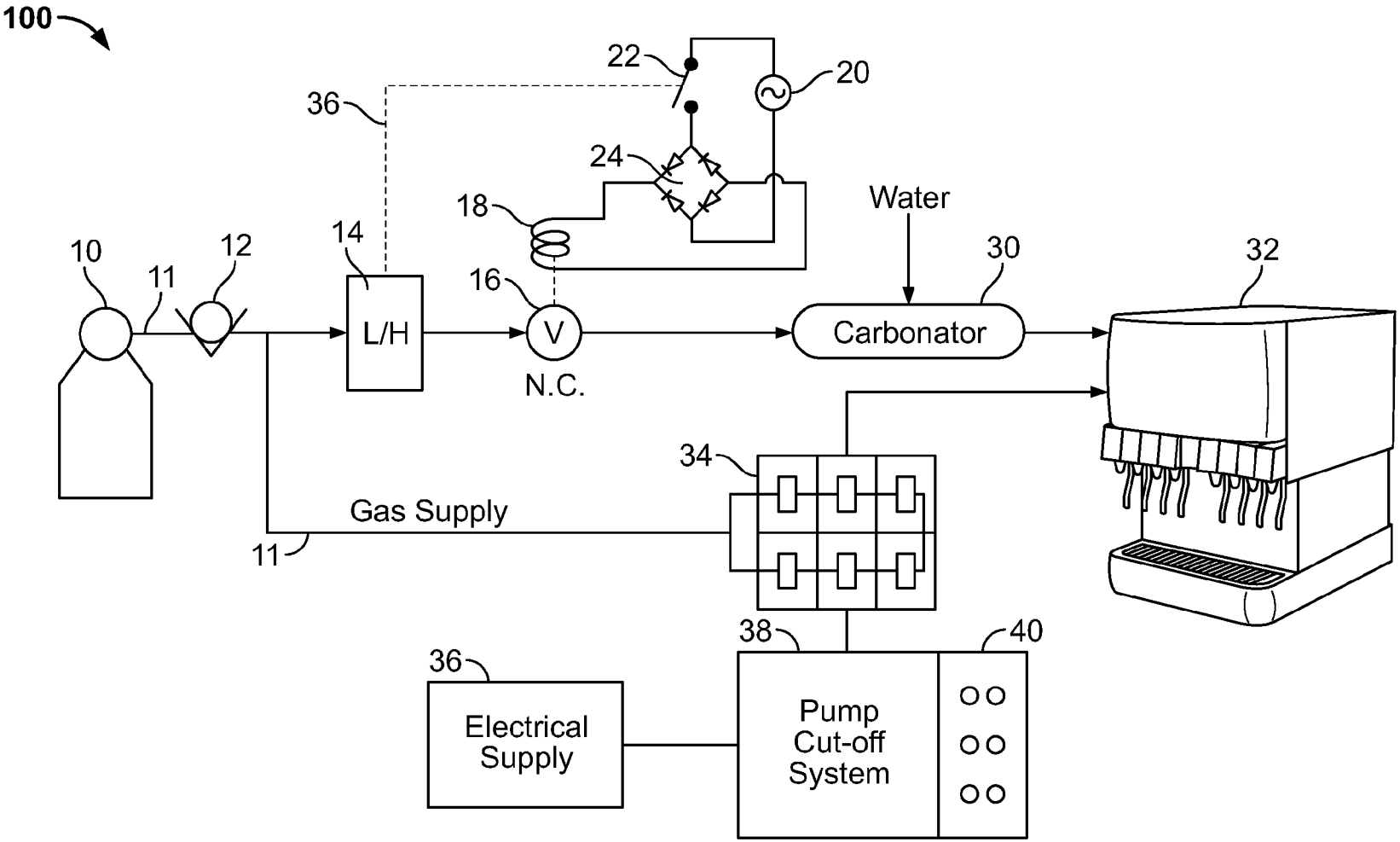
FIG. 1 shows a system for monitoring and controlling the flow of $CO_2$ in accordance with a preferred exemplary embodiment of the present invention.

Referring now to FIG. 1, a block diagram of a system 100 for monitoring and controlling the flow of $CO_2$ in accordance with a preferred exemplary embodiment of the safety system of the present invention is depicted. As shown in FIG. 1, system 100 is used in conjunction with a bulk cryogenic storage tank 10 of the type used to store and deliver liquid $CO_2$, converted to a gaseous state, suitable for application in a variety of applications.

One such application is shown in FIG. 1 is the use of bulk cryogenic storage tank 10 in conjunction with a beverage dispensing unit 32. Beverage dispensing unit 32 is fairly common and is used in many fast food restaurants and the like to dispense soft drinks A gas delivery line 11 is connected to a conventional high pressure regulator 12, which regulates the output gas flow from the tank 10 to a pressure in the approximate range of 90 to 110 PSI. Pressure regulator 12 and the pressure range for the $CO_2$ gas delivered from tank 10 is relatively conventional, in a range typically used by common beverage dispensing units, such as beverage dispensing unit 32.

After the connection to regulator 12, gas line 11 is connected to the input of a safety tank pressure monitor system or unit 14. Safety tank pressure monitor unit 14 is configured to monitor the pressure of gas in line 11 and, in the most preferred embodiments of the present invention, includes controls for sensing low pressure, a condition that may be caused by a leak in gas line 11 or by an open $CO_2$ connection downstream from pressure monitor unit 14.

Pressure monitor unit 14 typically includes user-adjustable electronic circuitry, or other suitable means, for continuously monitoring the pressure in line 11 as it flows through pressure monitor unit 14. The operation of pressure monitor unit 14, in conjunction with other portions of system 100, is described in greater detail below. After gas line 11 has passed through safety tank pressure monitor system 14, it is connected through a normally closed control valve 16, from which it then is connected to a conventional carbonator 30. Carbonator 30 is also supplied with water, as shown in FIG. 1. The output from carbonator 30 is supplied to the beverage 18 dispensing machine 32, along with syrup for selected beverages from 19 a single beverage box or, as shown in FIG. 1, a beverage box cluster 34. In the most preferred embodiments of the present invention, beverage box cluster 34 typically comprises a plurality of different beverage syrups, each contained in a separate beverage box, and the syrup from the beverage boxes can be combined with the output of carbonator 30 for use in providing carbonated beverages to consumers.

The manner in which syrup is delivered from the beverage boxes 34, and in which carbonated water is delivered from carbonator 30 to machine 32 is well known to those skilled in the art, and therefore is not discussed in any detail here. As noted above, $CO_2$ gas from storage tank 10 is generally supplied to a normally closed valve 16.

In order for valve 16 to be opened to deliver $CO_2$ gas to carbonator 30, a relay 18 must be operated. Relay 18 is electrically actuated and whenever electrical power to relay 18 is interrupted, the power supply to normally closed valve 16 is disconnected and valve 16 closes to prevent flow of $CO_2$ gas through system 100 to carbonator 30. This is the "fail safe" mode of operation for system 100 and is a safety mechanism that stops the flow of $CO_2$ in case of a problem.

Whenever the pressure sensed by a pressure sensor contained within safety pressure monitor unit 14 exceeds a pre-established pressure level (typically, in the normal pressure range of 90 PSI or more), a signal is supplied to close a normally open switch 22. This is indicated by dotted line 36 in the drawing. This signal and the particular type of switch, and the manner in which the switch is closed, may be of any suitable type. Switch 22 is indicated in the drawing diagrammatically as a single-pole-single-throw mechanical switch of the type that may be operated by a relay. Switch 22, however, may be a micro switch, or a transistor, electronic switch, or any other suitable type of switch. The particular type of switch is not critical to the invention; so it has been depicted functionally as shown in the drawing.

When switch 22 is closed by way of the link shown as the dotted line 36 in FIG. 1, power is applied from a suitable source of alternating current power 20, through a rectifier 24, to operate relay 18. When relay 18 is operated, valve 16 is opened, allowing gas to pass through valve 16 to carbonator 30 causing the system to operate in its normal mode of operation.

So long as there are no leaks or an unintentionally left open demand for $CO_2$ gas from beverage dispensing machine 32, system 100 operates as if safety tank pressure monitor unit 14 was not present.

In the event, however, that a sudden and/or prolonged drop in pressure as a result of a leak or other abnormal flow of gas out of tank 10 takes place, the low pressure condition is sensed by the safety tank pressure monitor unit 14; and switch 22 is opened. When switch 22 is opened, no further power is delivered to relay 18; and therefore, the normally closed valve 16 again closes. This terminates the delivery of $CO_2$ gas to carbonator 30, so long as the low pressure condition exists.

With valve 16 closed, however, the pressure in system 100 can stabilize and pressure is allowed to build up naturally as $CO_2$ gas is delivered from tank 10. The stabilization of system 100 at a preselected upper pressure automatically occurs as a result of the nature of the liquid $CO_2$ contained the tank 100. If there is a significant leak in system 100 (e.g., a rupture in tank 10) then it is possible that the pressure in system 100 may never stabilize at a level that would be high enough to open valve 16 again.

When and if the desired operating pressure is sensed by safety tank pressure monitor unit 14, switch 22 is closed and valve 16 is opened once again, thereby permitting flow of $CO_2$ gas to carbonator 30. If the condition that caused the low pressure sensing from safety tank pressure monitor unit 14 again takes place, however, as a result of a leak or other uncorrected continuous dispensing of the $CO_2$ gas, the low pressure condition once again will be established. Safety tank pressure monitor unit 14 again senses the low pressure and causes the valve 16 to be closed. Even though the system may cycle back and forth between a closed valve 16 and an open valve 16, freezing up or icing up of the system is prevented. Obviously, cycling back and forth between the open and closed operation of the valve 16 does not stop leakage, if the condition was caused by leakage.

Consequently, repair of whatever caused the $CO_2$ leak will still need to be performed. The safety monitor system, however, does provide for operation of beverage dispenser 32 until the necessary repairs can be made. The operation of dispenser 32 obviously will be interrupted whenever the valve 16 is closed so that the persons responsible for the system's operation are provided with a ready indication of some type of system malfunction. By employing the apparatus described herein, the malfunction however, will not result in a frozen condition of the $CO_2$ in tank 10; and by the nature of the operation of safety tank pressure monitor unit 14, it is possible to schedule a repair and inspection of the system at a more convenient time, rather than under some type of "emergency" situation.

In addition to safety tank pressure monitor unit 14 as described above, another aspect of the present invention is the use of an apparatus to disable the flow of $CO_2$ gas under circumstances other than a drop in pressure sensed by safety tank pressure monitor unit 14. For example, it is possible that the individual pumps associated with the beverage boxes may be pumping even though the product contained in the beverage box has been completely exhausted. This is an undesirable situation and may be addressed as set forth below.

Figure 2:
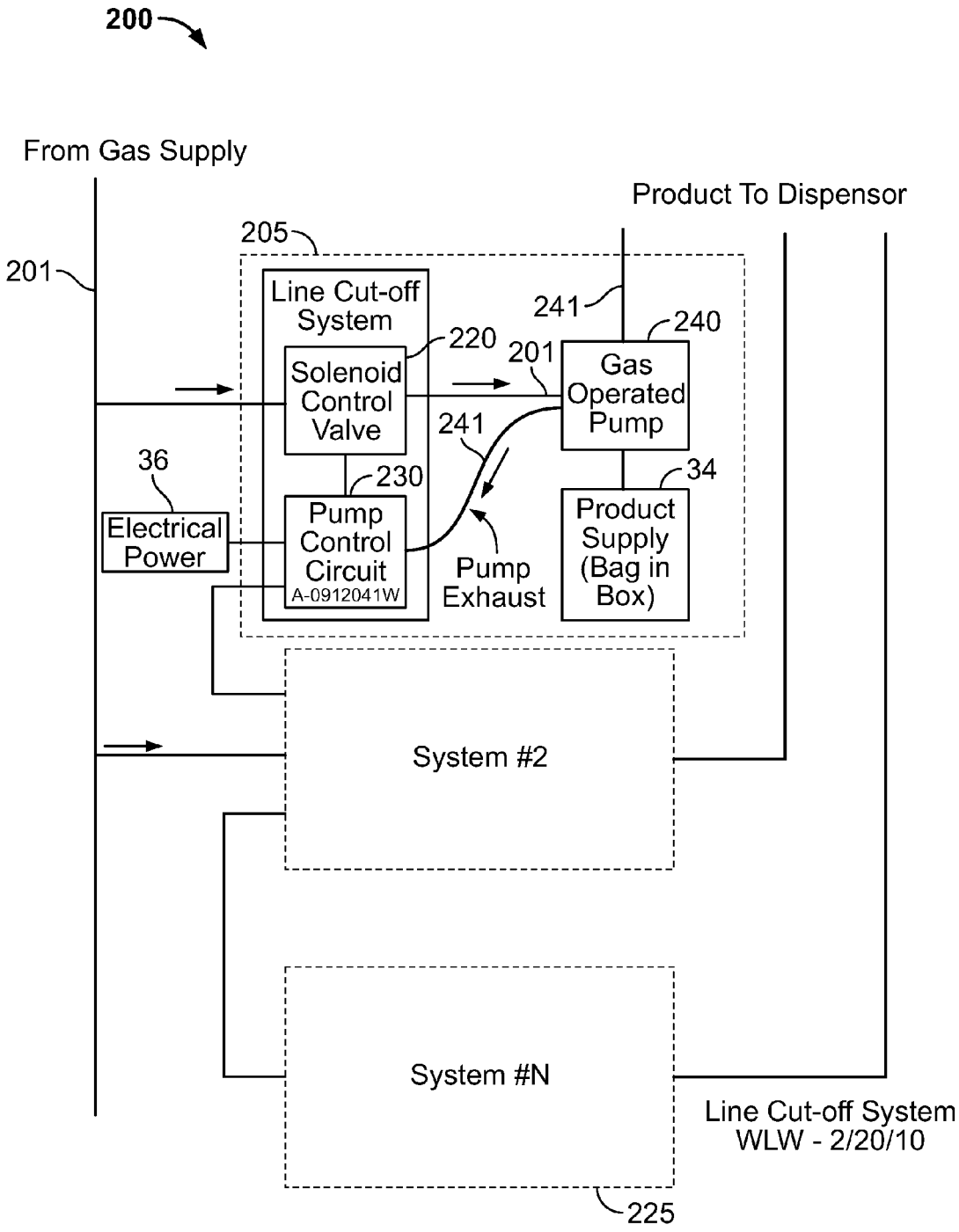
FIG. 2 shows a block diagram for a $CO_2$ shut-off circuit for use in conjunction with a system for monitoring and controlling the flow of $CO_2$ in accordance with a preferred exemplary embodiment of the present invention.

Referring now to FIG. 2, a line cut-off system 200 is configured to detect any irregularity in the continuous operation or other change in the operational characteristics of the gas-driven beverage pump due to an empty supply bag or other fault. In the most preferred embodiments of the present invention, this is accomplished by detecting the sound from the exhaust port of the pump drive.

In most beverage dispensing systems, the bag pumps that are connected to the product dispensing bags are gas-driven and generally powered by a compressed gas, typically $CO_2$ or air. However, the apparatus of the present invention is universal in nature and may be deployed with any pressurized gas used in beverage dispensing systems known to those skilled in the art. In the most preferred embodiments of the present invention, system 200 uses one or more monitoring devices to detect operational abnormalities in the flow of the product in the beverage dispensing system. For example, in the most preferred embodiment of the present invention, one or more electret microphone pickups are used to monitor the exhaust sound emanating from each of the bag pumps. Based on the change in one or more operational characteristics of the gas-driven pump (e.g., the sound associated with the pumping of the product from the bag), problems in the operation of the system can be detected. When the bag connected to the pump is out of product (e.g., syrup) the pump will generally operate at a higher frequency and a louder volume level, attempting to pump product from the empty bag.

While the use of the microphone to detect system anomalies is one of the most preferred embodiments, those skilled in the art will recognize that various other methods could be used to detect operational abnormalities or changes in the operational characteristics of the gas-driven pump associated with the pumping of product from one or more bags (e.g., pressure or flow transducer or switch, or any other flow detection method that can be used to detect a change in the flow rate of the liquid being pumped by the gas-driven pump). In any case, when the monitoring system (e.g., micro-controller and other associated components) detects a change in the operational characteristics of the gas-driven pump or otherwise determines that a problem exists in the monitored system, it closes a solenoid control valve that is in line with the source of gas (e.g. CO2 or compressed air) that supplies power to the pump, effectively disconnecting the air source that drives the gas-driven pump, thereby disabling the pump and terminating the operation of the pump. Additionally, in at least some preferred embodiments of the present invention, an LED indicator light may be configured to be illuminated at some location near the gas-driven pump or at some remote location to indicate that one or more of the pumps has disabled by the monitoring circuit. When the problem is corrected, the operator will reset circuit 200 with a pushbutton switch and the microcontroller opens the control valve, allowing the pump to operate normally once more. This may mean, in most cases, that one or more new boxes of liquid have been connected to the appropriate gas-driven pump so that the beverage can be delivered to the beverage dispensing system.

As shown in FIG. 2, system 205 includes a gas supply line 201 is used to provide CO2 or air to one or more product supply boxes or beverage boxes 34. For each beverage box 34, gas supply line 201 will pass through a line cut-off system solenoid control valve 220. Each beverage box 34 is connected to a gas-operated pump 240. Each gas-operated pump 240 is used to pump the contents of its respective beverage box 34 to beverage dispensing machine 32 of FIG. 1. Once the beverage box 34 has been emptied, the pump exhaust 241, which is coupled to a pump control circuit 230, will trigger a solenoid control valve 220, shutting off the flow of CO2 or air to gas-operated pump 240. This will have the effect of disabling gas-operated pump 240. In at least one preferred embodiment of the present invention, the output of pump exhaust 241 is the sound of gas-operated pump 240. In other preferred embodiments of the present invention, pump exhaust may comprise a flow transducer that monitors and detects the decrease in product flow being delivered by gas-operated pump 240 or some other similar mechanism. In any case, there will be a mechanism positioned at or near beverage box 34 and gas-operated pump 240 that will detect the reduced flow of product to beverage dispensing machine 32 and activate pump control circuit 230, thereby actuating solenoid control valve 220 and disabling gas-operated pump 240.

Although a single beverage box 34 is shown in conjunction with system 205, in most applications, there will be a plurality of beverage boxes, each connected to a pump control circuit 230 with each pump control circuit 230 being connected to electrical supply 36 and to beverage dispensing system 32 of FIG. 1.

Figure 3:
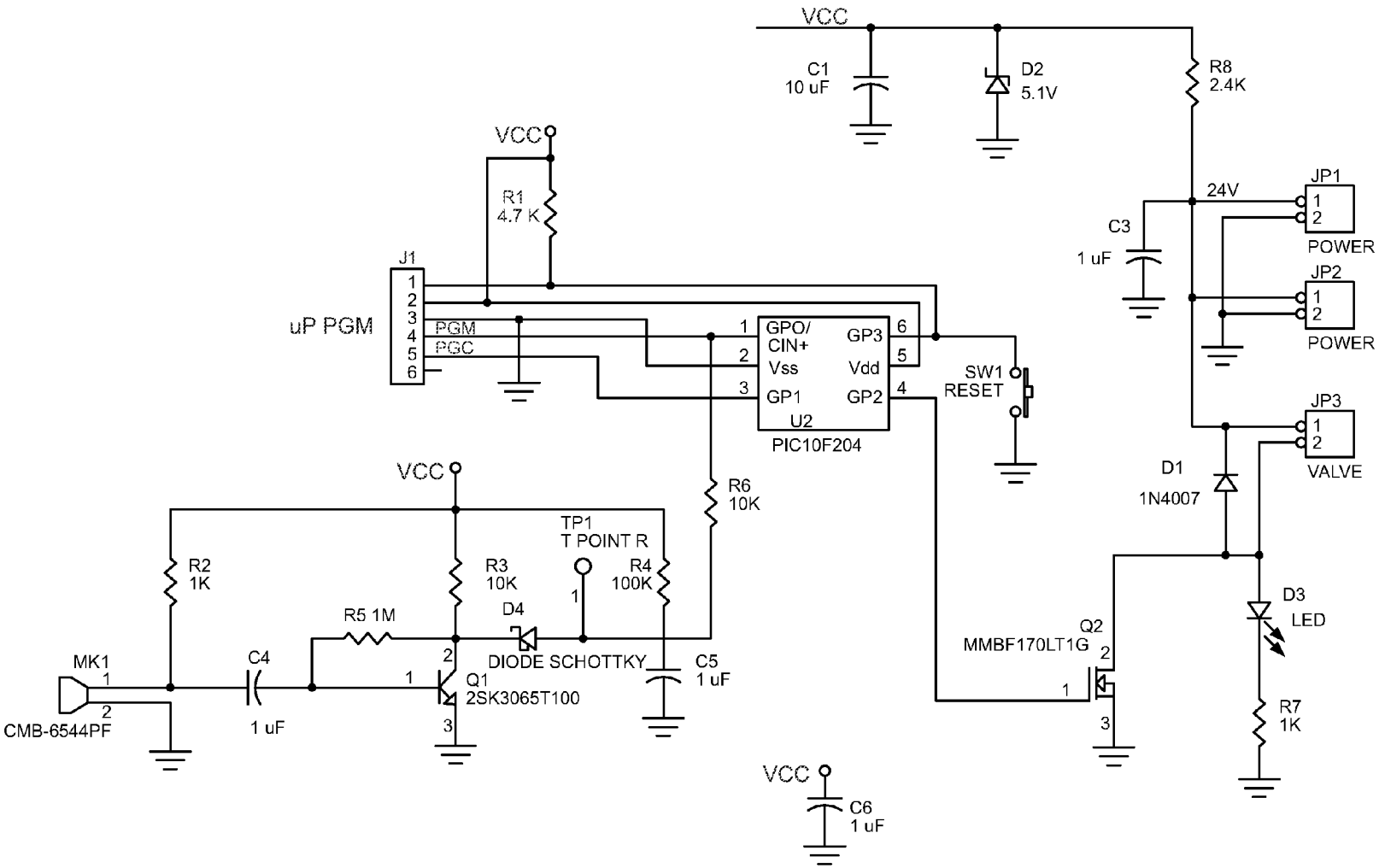
FIG. 3 shows a circuit diagram for a pump control circuit used in conjunction with a system for monitoring and controlling the flow of $CO_2$ in accordance with a preferred exemplary embodiment of the present invention.

Referring now to FIG. 3, a circuit schematic diagram 300 for implementing a specific preferred embodiment of system 200 of FIG. 2 is presented in greater detail. Those skilled in the art will recognize that this is only one way of implementing a single preferred embodiment of the present invention and that many other circuits may be utilized to accomplish the same result.

24 VDC power is supplied to JP1 from an external power supply, such as a wall transformer circuit. R8, C1, and Zener diode D2 provide a low voltage, low current VCC supply. JP2 is provided so that power may be connected from this circuit to the next in a daisy-chain fashion, reducing the length of wiring required for the system.

MK1 is an electret microphone mounted near the pumps so that it will pick up the sound from the pump exhaust. R2 provides bias current to the microphone. Q1 and its associated components C4, R3, and R5 amplify the signal from the microphone. R3 and R5 bias Q1 so that its collector voltage in the absence of sound is approximately ½ the supply voltage, VCC. In the absence of sound, C5 will also be charged by current through R4 to approximately ½ the supply voltage, VCC. When the signal from MK1 is strong enough, C5 will be discharged through D4 and the voltage on C5 will be reduced.

C5 is connected through R6 to pin 1 of micro-controller U2. Pin 1 is the input to a comparator circuit in U2. Its threshold is set to 0.6V so that when C5 is discharged below 0.6V the micro-controller recognizes that MK1 is receiving the necessary level of sound to indicate a problem with the pump. The program in the microcontroller uses the duration and frequency of occurrence for the sound to determine that there is a fault or that the bag connected to the pump is out of product (e.g. syrup).

Pin 4 of the microcontroller is connected to the gate of mosfet Q2. In the absence of a pump fault, the micro-controller holds the gate of Q2 high so that Q2 conducts current through the solenoid valve connected to JP3 and the valve is ON, allowing the pump to operate. Pin 2 of JP3 is essentially at ground potential and pin 1 of JP3 is connected to the 24V supply, supplying power to operate the solenoid valve. When the microcontroller determines that there is a fault, it pulls the gate of Q2 low, turning it off and turning off the solenoid valve. Pin 2 of JP3 is then pulled to 24V through the low resistance solenoid coil and LED D3 lights. The current through D3 is much too small to operate the solenoid valve. D1 provides for suppression of transient voltages from the inductive energy stored in the coil of the solenoid valve when it is on.

Switch SW1 is monitored by the micro-controller and when it is pressed, the micro-controller turns Q2 on again, actuating the solenoid valve.

J1 and R1 provide a means of programming U2 while in-circuit. This allows the micro-controller program to be easily changed for different conditions (e.g., adjusting the sound intensity or frequency for triggering the shut-off circuit).

Figure 4:
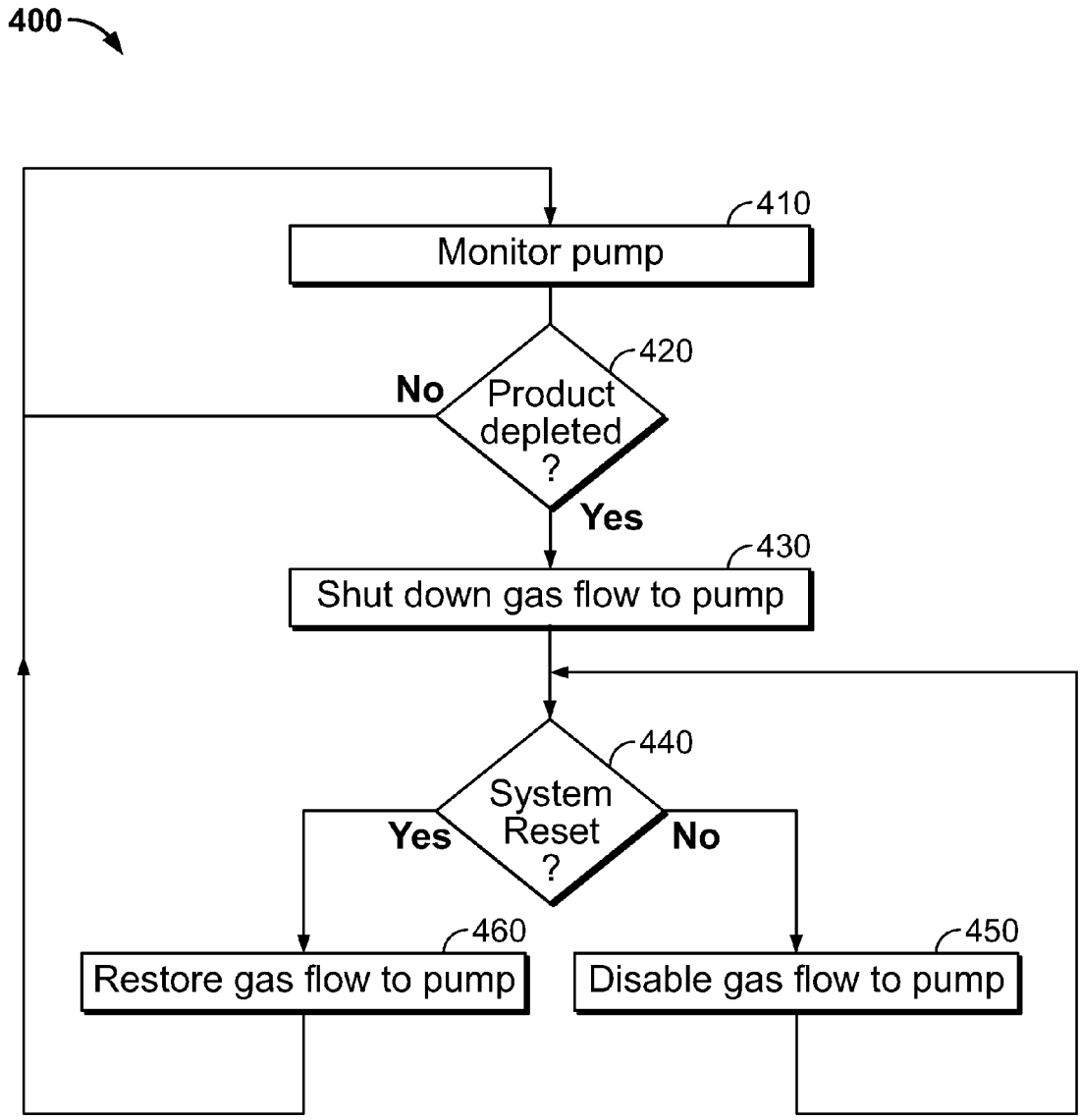
FIG. 4 shows a method for monitoring and controlling the flow of $CO_2$ in accordance with a preferred exemplary embodiment of the present invention.

Referring now to FIG. 4, a method 400 for monitoring and controlling the flow of CO2 in a beverage dispensing system in accordance with a preferred embodiment of the present invention is depicted.

As shown in FIG. 4, one or more gas powered pumps are monitored (step 410) to determine when the product being pumped by the gas powered pump has been depleted (step 420). As previously mentioned, there are a number of ways whereby the depletion of the product can be determined. In the most preferred embodiments of the present invention, the change in the sound of the operation of the gas powered pumps is detected by an electret microphone and used to activate a pump control circuit and a solenoid control valve, thereby disabling the flow of gas to the gas powered pump (step 430). As long as there is product available for the gas powered pump to pump, (step 420="NO"), then the pump will continue to operate and will be monitored by the system (step 410).

Once the system has been reset by the operator (step 440="YES") then the gas flow to the gas powered pump can be restored (step 450) and the pump will continue to be monitored once again (step 410). If the system has not been reset (step 440="NO") then the gas flow to the gas powered pump will remain disabled (step 460).

From the foregoing description, it should be appreciated that an enhanced apparatus and methods for monitoring CO2 is provided by the various preferred embodiments of the present invention and that the various preferred embodiments offer significant benefits that would be apparent to one skilled in the art. Furthermore, while multiple preferred embodiments have been presented in the foregoing description, it should be appreciated that a vast number of variations in the embodiments exist. Lastly, it should be appreciated that these embodiments are preferred exemplary embodiments only and are not intended to limit the scope, applicability, or configuration of the invention in any way. Rather, the foregoing detailed description provides those skilled in the art with a convenient road map for implementing a preferred exemplary embodiment of the invention, it being understood that various changes may be made in the function and arrangement of elements described in the exemplary preferred embodiment without departing from the spirit and scope of the invention as set forth in the appended claims.

What is claimed is:

1. An apparatus comprising:

a bulk tank source of pressurized gas;

at least one gas-driven pump;

a control valve;

a gas supply line connected from the bulk tank source of pressurized gas through the control valve to the gas-driven pump; and a monitoring system configured to monitor the operation of the gas-driven pump and further configured to close the control valve whenever the monitoring system detects a change in the operational characteristic of the at least one gas-driven pump.

2. The apparatus of claim 1 wherein monitoring system comprises:

a microphone configured to monitor at least one sound emanating from an exhaust port on the gas-driven pump; and a microcontroller configured to open and close the control valve.

3. The apparatus of claim 1 wherein the monitoring system comprises a flow rate monitoring device configured to detect a drop in the flow rate of a liquid being pumped by the gas-driven pump.

4. The apparatus of claim 1 wherein the bulk tank source of pressurized gas is a source of one of pressurized liquid carbon dioxide or pressurized oxygen.

5. The apparatus of claim 1 further comprising a beverage dispensing system coupled to the at least one gas-driven pump.

6. The apparatus of claim 1 wherein the control valve is an electrically controlled valve and the monitoring system produces an electrical control signal to operate the control valve.

7. The apparatus of claim 1 further comprising a second control valve and wherein the second control valve is a normally closed valve and a pressure monitor system operates to maintain the second control valve open at pressures in a gas supply line above a first predetermined threshold.

8. The apparatus of claim 1 wherein the gas-driven pump is configured to deliver a liquid from a plurality of beverages boxes to a beverage dispensing device.

9. The apparatus of claim 7 wherein the monitoring system is configured to:

supply a pressurized gas from the bulk tank to a consumption device monitoring the pressure of gas supplied from the bulk tank;

prevent the supplying of gas from the bulk tank to the consumption device whenever a monitored pressure falls below a first predetermined threshold;

re-supplying gas from the bulk tank to the consumption device whenever the monitored pressure rises above a second predetermined threshold greater than the first predetermined threshold; and automatically repeating the preventing of supplying gas from the bulk tank and re-supplying the gas as the pressures vary between the first and second predetermined thresholds.

10. A method comprising the steps of:

a) delivering a pressurized gas to at least one gas-driven pump;

b) using the at least one gas-driven pump to deliver a liquid;

c) monitoring a flow of a liquid being pumped by the at least one gas-driven pump;

d) detecting a change in the operational characteristics of the at least one gas-driven pump; and e) shutting down the flow of a gas to the gas-driven pump; thereby interrupting the flow of the liquid being pumped by the at least one gas-driven pump.

11. The method of claim 10 wherein the pressurized gas is one of liquid carbon dioxide and oxygen.

12. The method of claim 10 wherein the step of monitoring the flow of a liquid being pumped by the at least one gas-driven pump comprises the step of using a microphone to monitor at least one sound associated with said gas-driven pump.

13. The method of claim 10 wherein the step of monitoring the flow of a liquid being pumped by the at least one gas-driven pump comprises the step of using a flow meter to detect a drop in the flow of the liquid being pumped by the at least one gas-driven pump.

14. The method of claim 10 further comprising the step of:

f) restarting the flow of the gas to the at least one gas-driven pump after disconnecting an empty box from the gas-driven pump and connecting a full box of liquid to the at least one gas-driven pump.

15. The method of claim 10 wherein the liquid is a beverage.

16. The method of claim 10 further comprising the steps of:

f) restarting the flow of the gas to the at least one gas-driven pump after disconnecting an empty box from the gas-driven pump and connecting a full box of liquid to the at least one gas-driven pump; and g) continually repeating steps a)-f) for more than one cycle.

17. The method of claim 10 wherein the liquid is stored in a plurality of beverage boxes.

18. The method of claim 10 wherein the at least one gas-driven pump comprises a plurality of gas-driven pumps and wherein at least one beverage box is connected to each of the plurality of gas-driven pumps.

19. The method of claim 10 wherein the liquid is a beverage and wherein the step of monitoring the flow of a liquid being pumped by the gas-driven pump comprises the step of using a microphone to monitor at least one sound associated with said gas-driven pump.

20. The method of claim 10 further comprising the steps of:

supplying pressurized carbon dioxide (CO2) from a bulk tank to a consumption device;

monitoring the pressure of gas supplied from the bulk tank;

preventing the supplying of gas from the bulk tank to the consumption device whenever the monitored pressure falls below a predetermined threshold; and resupplying gas from the bulk tank to the consumption device whenever the monitored pressure rises above a second predetermined threshold greater than the first predetermined threshold; and automatically repeating the preventing of supplying gas from the bulk tank and re-supplying the gas as the pressures vary between the first and second predetermined thresholds.

* * * * *